United States Patent [19]

Lindskog et al.

[11] Patent Number: 4,603,028

[45] Date of Patent: Jul. 29, 1986

[54] METHOD OF MANUFACTURING SINTERED COMPONENTS

[75] Inventors: Per F. Lindskog, Höganäs; Göran E. Wastenson, Viken, both of Sweden

[73] Assignee: Hoganas AB Fack, Hoganas, Sweden

[21] Appl. No.: 757,143

[22] Filed: Jul. 22, 1985

Related U.S. Application Data

[63] Continuation of Ser. No. 537,533, Sep. 30, 1983, abandoned, which is a continuation of Ser. No. 419,866, Sep. 20, 1982, abandoned, which is a continuation of Ser. No. 167,039, Jul. 9, 1980, abandoned, which is a continuation of Ser. No. 13,253, Feb. 21, 1979, abandoned, which is a continuation of Ser. No. 809,796, Jun. 24, 1977, abandoned.

[30] Foreign Application Priority Data

Jun. 24, 1976 [SE] Sweden ..... 7607284

[51] Int. Cl.[4] ..... B22F 1/00

[52] U.S. Cl. ..... 419/23; 75/123 R; 75/123 D; 75/132; 75/243; 419/38; 419/57; 419/58; 419/59

[58] Field of Search ..... 75/123 R, 123 D, 132, 75/243; 419/23, 38, 57–59

[56] References Cited

U.S. PATENT DOCUMENTS 4,006,016 2/1977 Zambrow et al. ..... 419/28

4,236,945 12/1980 Reen ..... 419/10

*Primary Examiner*—Stephen J. Lechert, Jr.

*Attorney, Agent, or Firm*—Eugene E. Renz, Jr.

[57] ABSTRACT

A powder metallurgical method is described for producing precision components of sintered steel having high strength and high ductility by compressing a powder to form a green compact and sintering the latter at a temperature from 950° to 1250° C. for 5 to 90 minutes in a reducing atmosphere of partially combusted hydrocarbons, sufficient carbon being present to impart a carbon content of 0.05 to 0.6% by weight in the sintered steel; said powder consisting essentially of iron powder containing 0.65 to 0.8% phosphorus, 0.1 to 0.5% graphite or carbon powder, and 0 to 1.5% of a solid lubricant.

4 Claims, 2 Drawing Figures

METHOD OF MANUFACTURING SINTERED COMPONENTS

Figure 1:
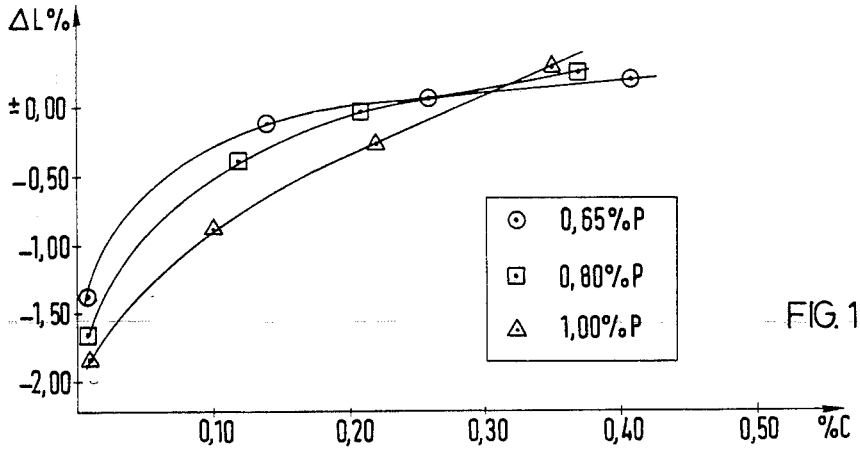

This is a continuation of application Ser. No. 537,533 filed Sept. 30, 1983, now abandoned, which is a continuation of application Ser. No. 419,866 filed Sept. 20, 1982, now abandoned, which is a continuation of application Ser. No. 167,039 filed July 9, 1980, now abandoned, which is a continuation of application Ser. No. 013,253 filed Feb. 21, 1979, now abandoned, which is a continuation of application Ser. No. 809,796 filed June 24, 1977, now abandoned.

The present invention relates to a method of manufacturing precision components from sintered steel by means of powder metallurgy, said steel being characterized by high strength as well as high ductility.

The use of phosphorus as an alloying element in powder metallurgy for providing sintered components having improved mechanical properties has been more and more common. Thus, powder mixtures including up to 0.6% phosphorus by weight and consisting of iron powder and ferrophosphorus powder have been used for a couple of years. (Here as well as in the following % relates to weight-%.) Sintered steel manufactured by compressing and sintering such powders are characterized by a combination of high mechanical strength and ductility. This combination makes phosphorus alloys superior to other known alloying systems for sintered steel and seems to be the most important reason for the advance of phosphorus as an alloying element. However, a considerable shrinkage of the green compacts takes place during the sintering thereof especially at high contents of phosphorus, which shrinkage is not desirable. As one of the advantages of powder metallurgical manufacturing resides in the fact that it is possible to mass produce components having good accuracy the property of causing shrinkage during the sintering restricts the utility of the phosphorus. It has been shown that the shrinkage can be counteracted by adding copper or small amounts of graphite. To a certain extent this method has hitherto been used in sintered alloys having phosphorus contents up to 0.6% by weight.

The present invention suggests a method wherein the advantages of the phosphorus as an alloying element are more completely utilized than before. By proceeding in accordance with the invention, there are obtained sintered components having a strength which compares favorably with the high strength sintered steel using the expensive alloying elements nickel and molybdenum for improving the strength. At the same time, these sintered components are superior to said sintered steels with respect to ductility. Furthermore, the dimensional change during the sintering process is negligible and relatively stable with regard to small variations of the contents of the alloying elements.

The method acording to the invention is characterized in that the iron based powder mixture consisting of, in addition to iron, phosphorus in a content of between 0.65 and 1.1.%, up to 0.6% carbon or graphite powder and lubricants is compressed to green compacts which are then sintered at a temperature of between 950° and 1250° C., preferably between 1050° C. and 1150° C. during 5 to 90 minutes, preferably 15 to 30 minutes, in such a reducing atmosphere that the components after the sintering have a carbon content of between 0.05 and 0.06%, suitably between 0.1 and 0.5%. The desired carbon content is obtained by the fact that the added carbon or graphite powder is dissolved and/or that the sintering atmosphere has such a carbon potential that the material is carburized and obtains the desired carbon content. Usually this takes place because of the fact that the atmosphere consists of partially combusted hydrocarbons.

Figure 2:
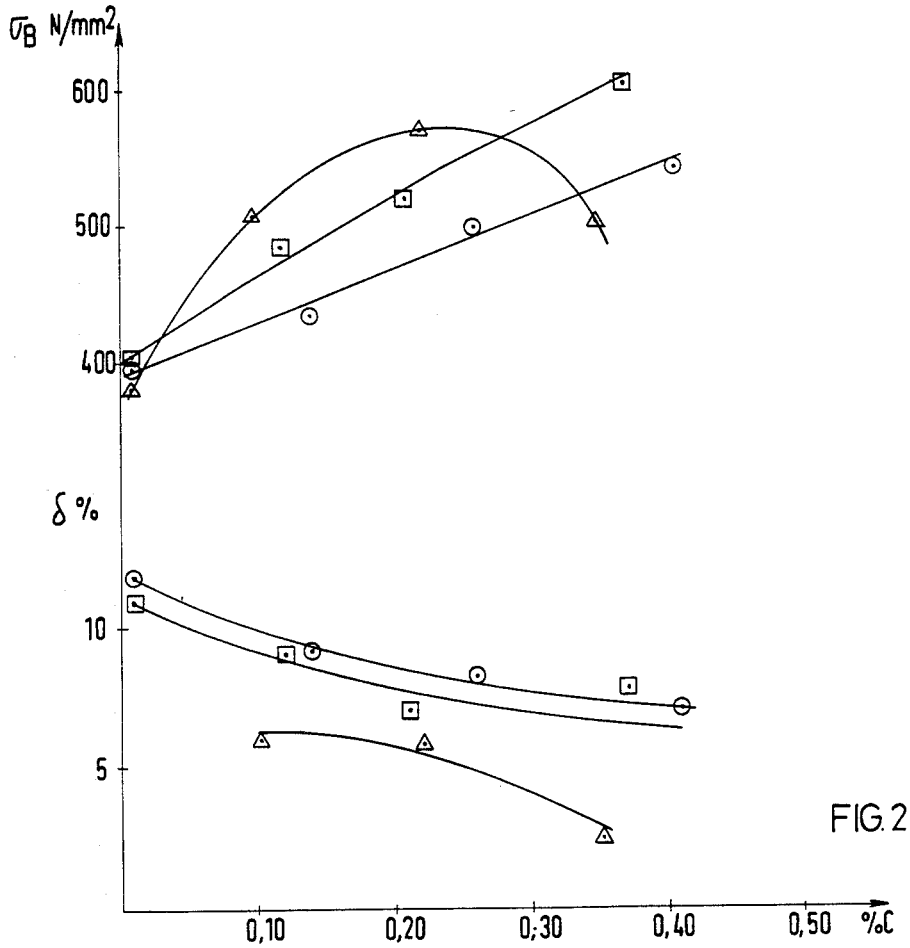

FIG. 1 is a family of curves showing the relationships between the percentage of carbon in the sintered steel and the dimensional change under test for samples containing 0.65%; 0.80%; and 1.00% phosphorus by weight, respectively; and FIG. 2 is a plot of two families of curves for the samples of FIG. 1, showing respectively, the relationship of tensile strength and the elongation at fracture to the carbon content of the samples.

The invention is described in with reference to the following examples from which also appears more detailed conclusions concerning the desired composition of sintered steel manufactured according to the invention.

EXAMPLE 1

In order to establish the influence of phosphorus and carbon contens on the dimensional changes during the sintering operation, powder mixtures comprising iron powder, ferrophosphorus powder having a phosphorus content of 15.8% and graphite powder were provided. Powder mixtures having three different contents of phosphorus, i.e. 0.65, 0.80 and 1.00% were provided. For each content of phosphorus different amounts of graphite powder were added, from 0 to 0.45%. Additionally zinc stearate powder was added as a lubricant.

The powder mixture was pressed to tensile test bars according to MPIF Standard 10–63 at a pressure of 588 MPa. The test bars were placed in sintering boxes with a getter powder and were sintered at 1120° C. in cracked ammonia for 60 minutes. The dimensional change of the bars thereby provided is shown in FIG. 1.

EXAMPLE 2

The tensile test bars from the above example were examined with respect to tensile strength and elongation at fracture. The results of this investigation are shown diagrammatically in FIG. 2.

It appears that high contents of phosphorus, i.e. more than 1%, give a strength maximum at 0.2% carbon in the sintered steel. If the carbon content is increased any further, the strength will be lowered again because of the formation of cementite. However, lower phosphorus contents than 1% give, as appears for Example 2, a continuous increase of the strenght with increased carbon contents up to 0.5% carbon, and in order to obtain high strength, the phosphorus content should be between 0.7 and 0.9%, i.e. around 0.8%. Such a sintered steel obtains its high strength without any substantial descrease of the ductility which is usual for sintered steel including other alloying elements for increasing the strength. Furthermore, a material having this content of phosphorus obtains a dimensional change which is relatively stable around zero within a certain range of carbon contents. For phosphorus contents up to 0.8% this range is 0.1–0.5%, while the sintered steel should have a carbon content of between 0.2 and 0.4% at higher phosphorus contents. At a carbon content of 0.35% the dimensional change is almost independent of the phosphorus content. The carbon contents mentioned above relate to the carbon contents of the sintered steel. As mentioned above, the carbon contents can be obtained either by performing the sintering in a carburizing atmosphere or mixing a graphite powder into the ironphosphorus mixture. In this connection it should be noted that the amount of graphite so added usually corresponds to a somewhat lower final carbon content of the sintered steel.

Powder metallurgical manufacturing by compressing a metal powder in dies requires that a good lubrication of the contact surface between the powder body and the die be maintained. This can be provided by adding to the powder mixture a solid lubricant such as zinc stearate. The powder to be used for performing the method according to the invention consists of not more than 1.5% preferably between 0.5 and 1.0%, of a solid lubricant. In addition to iron, phosphorus, carbon and lubricants the powder mixture can include small amounts of elements which are not desired but cannot be avoided when usual manufacturing methods are used.

The powder mixuture which is used in realizing the method according to the invention is, as mentioned above, a mixture of different components. The main component is an iron powder adapted for powder metallurgical manufacturing of sintered components. It has a maximum particle size which is less than 0.5 mm, and preferably the maximum particle size of this iron powder is 0.15 mm. The phosphorus-containing component of the powder mixture is a ferrophosphorus powder having such a phosphorus content that there is provided a melted phase rich in phosphorus in sintering at the temperatures mentioned above. This is obtained when the phosphorus content of the ferrophosphorus is more than 2.8%. A suitable maximum content has appeared to be 27%. However, for the most applications a phosphorus content in the ferrophosphorus powder of 14–27% is preferred.

The particle size of the ferrophosphorus powder has been shown to be a critical significance for the toughness properties of the phosphorus alloyed sintered steel. A particle size of the ferrophosphorus powder which is too high has been shown to cause brittle fractures of the sintered steel. Thus, the maximum particle size of the ferrophosphorus powder should not exceed 45 um and should preferably be less than 20 μm.

In addition to iron powder, ferrophosphorus powder and lubricant the powder mixture includes graphite powder. The graphite powder should have a particle size less than 20 μm. preferably less than 10 μm, suitably less than 5 μm.

In this case there is a great difference between the particle sizes of the powder components of the mixture, and this fact leads to an especially great risk of segregation leading to an uneven distribution of the alloying elements. In order to reduce the tendency of segregation of the mixture in connection with the mixing operation 50–200 g fluid mineral oil per metric ton of the powder can be added during the mixing operation. This contributes to adhering the small alloying particles to the larger iron powder particles.

In order to improve the protection against segregation still further, the iron-ferrophosphorus powder mixture (without the addition of graphite and lubricant) with or without the addition of oil is heated in a reducing atmosphere to a temperature of between 650° and 900° C. for a period of 15 minutes to 2 hours. Thereby, the powder is loosely sintered together so that a subsequent careful disintegration may be carried out in order to restore the original particle size. The powder obtained in this way is composed of iron particles with particles of the fine grained ferrophosphorus powder sintered thereto. The graphite and lubricant are then mixed with this powder.

The methods described above in order to avoid segregation can be applied to a mixture having an increased content of ferrophosphorus powder. The concentrate thus obtained can be mixed with iron powder to provide for the desired phosphorus content in the final product.

We claim:

1. In a powder metallurical method for the manufacture of precision components of sintered steel having both high strength and high ductility, which comprises compressing a powder to form a green compacted mass and sintering said mass at a temperature of from about 950° to about 1250° C. for from about 5 to about 90 minutes in a reducing atmosphere, said powder consisting essentially of iron powder containing from 0.65 to about 0.8% phosphorus by weight, from 0.1% to about 0.5% graphite or carbon powder by weight, and from 0% up to about 1.5% of a solid lubricant by weight, the improvement which comprises providing sufficient carbon in said system during said sintering operation to provide a carbon content of from about 0.05 to about 0.6% by weight in said sintered steel component.

2. A method according to claim 1 wherein the phosphorus content of the powder is about 0.8% by weight and the sintered steel components are provided with a carbon content of about 0.35% by weight.

3. A method according to claim 1 wherein the iron powder has a particle size less than about 0.5 μm, the phosphorus content is supplied as a ferrophosphorus powder containing about 14 to about 27% phosphorus by weight and having a maximum particle size less than about 20 μm, and the carbon content of the sintered steel components is supplied at least in part by graphite powder having a particle size less than about 10 μm.

4. A method according to claim 1 wherein the phosphorus content of the powder is about 0.8% by weight and the sintered steel components are provided with a graphite content of about 3.35% by weight.

* * * * *